US007967504B2

(12) United States Patent
Tschumi et al.

(10) Patent No.: US 7,967,504 B2
(45) Date of Patent: Jun. 28, 2011

(54) PUSH-BUTTON CONTROL DEVICE FOR A WATCH

(75) Inventors: Philipp Tschumi, Niederwil (CH); Sébastien Briswalter, Pfetterhouse (FR); Vincent Brunner, Les Reussiles (FR)

(73) Assignee: Montres Rado S.A., Lengnau (CH)

( * ) Notice: Subject to any disclaimer, the term of this patent is extended or adjusted under 35 U.S.C. 154(b) by 262 days.

(21) Appl. No.: 12/416,653

(22) Filed: Apr. 1, 2009

(65) Prior Publication Data

US 2009/0251999 A1 Oct. 8, 2009

(30) Foreign Application Priority Data

Apr. 1, 2008 (EP) ..... 08153922

(51) Int. Cl.
*G04B 29/00* (2006.01)

(52) U.S. Cl. ..... 368/308; 368/319

(58) Field of Classification Search ..... 368/206, 368/288–290, 306–308, 318–321; 200/302.1, 200/302.2, 345
See application file for complete search history.

(56) References Cited

U.S. PATENT DOCUMENTS

| | | | | |
|---|---|---|---|---|
| 5,521,890 | A | 5/1996 | Miche et al. | |
| 6,137,750 | A * | 10/2000 | Rieben | 368/290 |
| 7,192,182 | B2 * | 3/2007 | Hiranuma et al. | 368/289 |
| 2008/0008053 | A1 * | 1/2008 | Zimmermann | 368/319 |

FOREIGN PATENT DOCUMENTS

| | | |
|---|---|---|
| EP | 0 655 664 A1 | 5/1995 |
| EP | 1 102 136 | 5/2001 |

OTHER PUBLICATIONS

Search Report issued in corresponding application No. EP 08 15 3922, completed Dec. 16, 2008.

* cited by examiner

*Primary Examiner* — Vit W Miska
(74) *Attorney, Agent, or Firm* — Griffin & Szipl, P.C.

(57) ABSTRACT

The push-button control device for a watch includes a push-button stem (28) inserted via a bottom end into an orifice (22, 23) of a watchcase and a button (29) mounted on a top part (28*a*) of the stem (28) outside the watchcase. The stem can slide axially between a rest position and an active position against a return member (35) to control at least one function of the watch. The control device is characterized in that the top part (28*a*) of the stem includes an annular groove delimited by two parallel shoulders (44, 46) perpendicular to the axis of the stem, and in that the button (29) includes an annular base (27) that is engaged in the groove so as to be held between the two shoulders (44, 46) in the axial direction and centred with some play by the bottom of the groove such that the button (29) is free to move off-centre relative to the axis of the stem (28) while remaining secured thereto.

7 Claims, 3 Drawing Sheets

PUSH-BUTTON CONTROL DEVICE FOR A WATCH

This application claims priority from European Patent Application No. 08153922.3, filed Apr. 1, 2008, the entire disclosure of which is incorporated herein by reference.

FIELD OF THE INVENTION

The present invention concerns a push-button control device for a watch, and in particularly a push-button control device wherein the button can be pushed, at least in part, into the middle part of the watch when the control device is activated.

BACKGROUND OF THE INVENTION

Numerous push-button control devices matching the above definition are known. By way of example, FIG. 1 illustrates a prior art device of this type. Referring to FIG. 1, middle part 1 of a watch has a recess 2 whose bottom has a bore 3 in which the push-button tube 4, which is fixed in the middle part, is engaged. A push-button stem 8 associated with a button 9 is arranged inside the tube so as to slide axially therein between a rest position and an active position. Button 9 includes a cap 5 that projects outside recess 2. It can be seen that cap 5 has an annular hollow 11 formed around a central cylindrical portion into which the threaded end of stem 8 is screwed. The stem and button 9 are returned to the rest position by a helical spring 13 surrounding the central cylindrical portion of cap 5. Spring 13 abuts, via one end thereof, against the bottom of annular hollow 11, whereas the other end thereof is engaged in tube 4. In the example illustrated, tube 4 is sealed in a water resistant manner by an O-ring gasket 6, which is arranged in annular hollow 11. The size of gasket 6 is such that it is compressed between the outer edge of the hollow and push-button tube 4. Button 9 also includes a ring 7, which closes the periphery of hollow 11 and which is provided for holding sealing gasket 6 in position.

One problem with devices of the type that has just been described is that it is generally impossible to adjust the dimension of recess 2 exactly to that of button 9. Indeed, with usual manufacturing tolerances, a gap has to be provided to act as a clearance space between button 9 and the wall of recess 2. One drawback of the presence of this gap is that it allows dirt to accumulate between pushbutton 9 and middle part 1. Moreover, even a slight error in centring button 9 relative to recess 2 can be detrimental to the attractiveness of the watch.

The above problem arises even more acutely in the frequent case where the middle part of the watch for which the push-button control device is intended, includes a cap used for covering a subjacent structure made of material that is easier to machine or cheaper. Such watchcases formed of a centre made of a first material covered with a protective or decorative cap made of a second material are well known to those skilled in the art. By way of example, EP Patent No. 1,102,136 discloses a watchcase including a centre made of steel covered with a cap made of very hard, scratchproof material, such as a ceramic material.

FIG. 2 illustrates, by way of example, a chronograph watch fitted with push-button control devices 29 and whose case is covered with a cap made of ceramic material, for example. With a watch of this type, the push-button stem naturally has to pass both through the cap and the centre of the watchcase. The cap and the centre of the case must therefore both have an aperture, and the aperture in the cap must be superposed, as precisely as possible, on the aperture in the centre of the case once the two components of the case are assembled. It is known, however, that the more difficult it is to machine the material in which the part is made, the greater the manufacturing tolerances of the machined part will normally be. Adjustment precision of the cap on the centre largely depends upon the precision with which the cap has been made.

FIG. 3 illustrates, by way of example, an alignment error between the aperture arranged in the steel centre and the aperture in cap 22. It is easy to see that insertion of a push-button control device into such poorly aligned apertures might cause problems. The pushbutton is even liable to be so off-centre that it simply does not pass through the aperture made in the ceramic cap. Moreover, even if the alignment error is not sufficient to prevent the pushbutton passing through, it may compromise the aesthetic qualities of the watch.

SUMMARY OF THE INVENTION

It is an object of the invention to provide a solution to the alignment problems that have just been described. The present invention achieves this object by providing a push-button control device for a watch, including a push-button stem inserted by a bottom end into an orifice in a watchcase and a button mounted on a top part of the stem outside the watchcase, said button including a cap that covers the top end of the stem, said stem being able to slide axially between at least a rest position and an active position against a return member to control at least one function of said watch, said device being characterized in that said top part of the stem includes an annular groove delimited by two parallel shoulders perpendicular to the axis of the stem, and in that the button includes an annular base engaged in said groove so as to be held in the axial direction between the two shoulders and centred with some play by the bottom of the groove such that the button is free to move off-centre relative to the axis of the stem, while remaining secured thereto.

It is clear that the existence, according to the invention, of a play between the annular base surrounding the stem and the bottom of the groove enables the pushbutton to move sideways relative to the push-button stem, thereby making it possible to compensate for any poor alignment.

BRIEF DESCRIPTION OF THE DRAWINGS

Other features and advantages of the present invention will appear more clearly upon reading the following detailed description, given solely by way of non-limiting example, and made with reference to the annexed drawings, in which.

DETAILED DESCRIPTION OF THE ILLUSTRATIVE EMBODIMENTS

Figure 1:
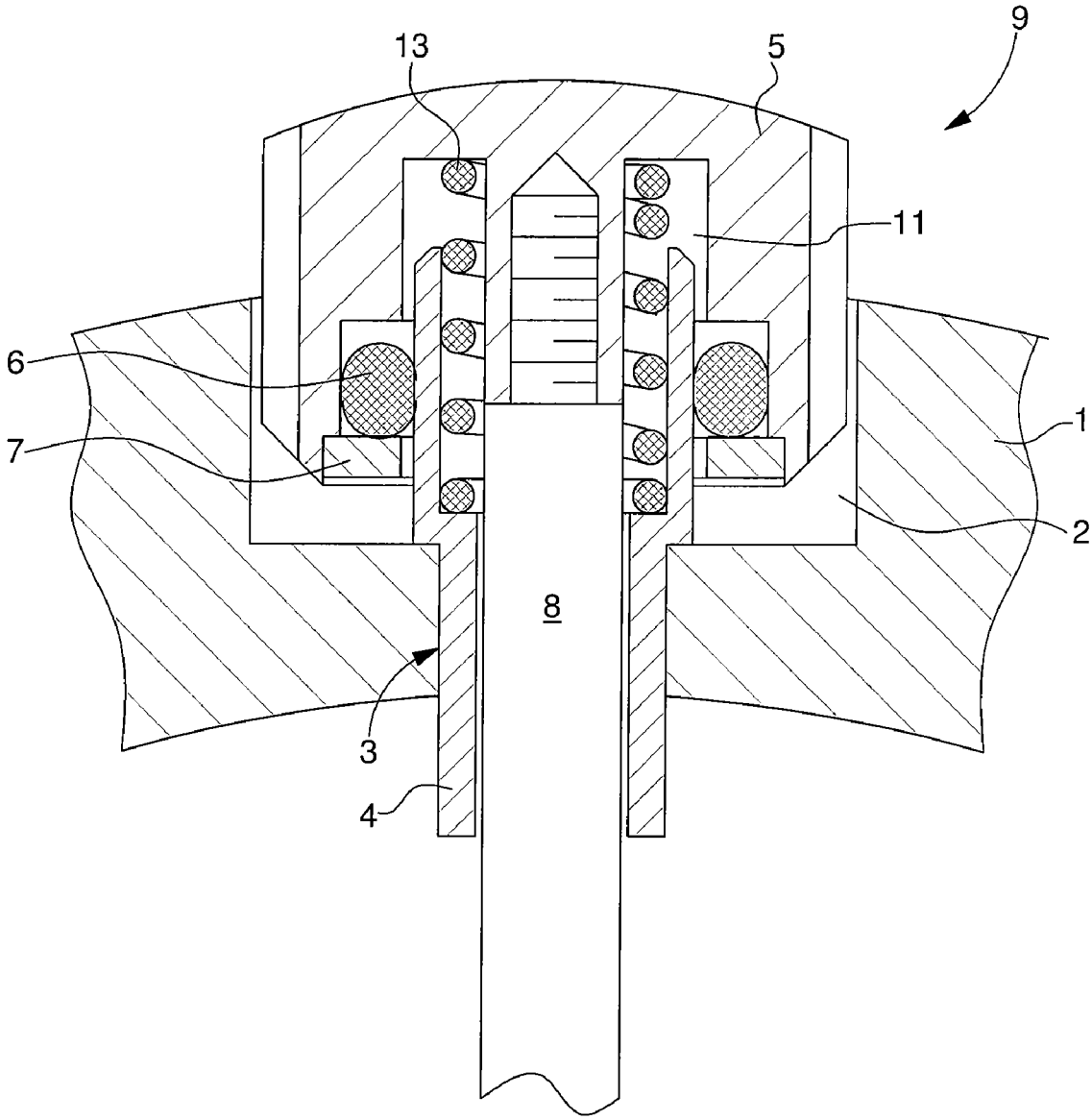
Fig. 1 ( Prior Art )
FIG. 1 is a cross-section of a push-button control device of the prior art.
Figure 2:
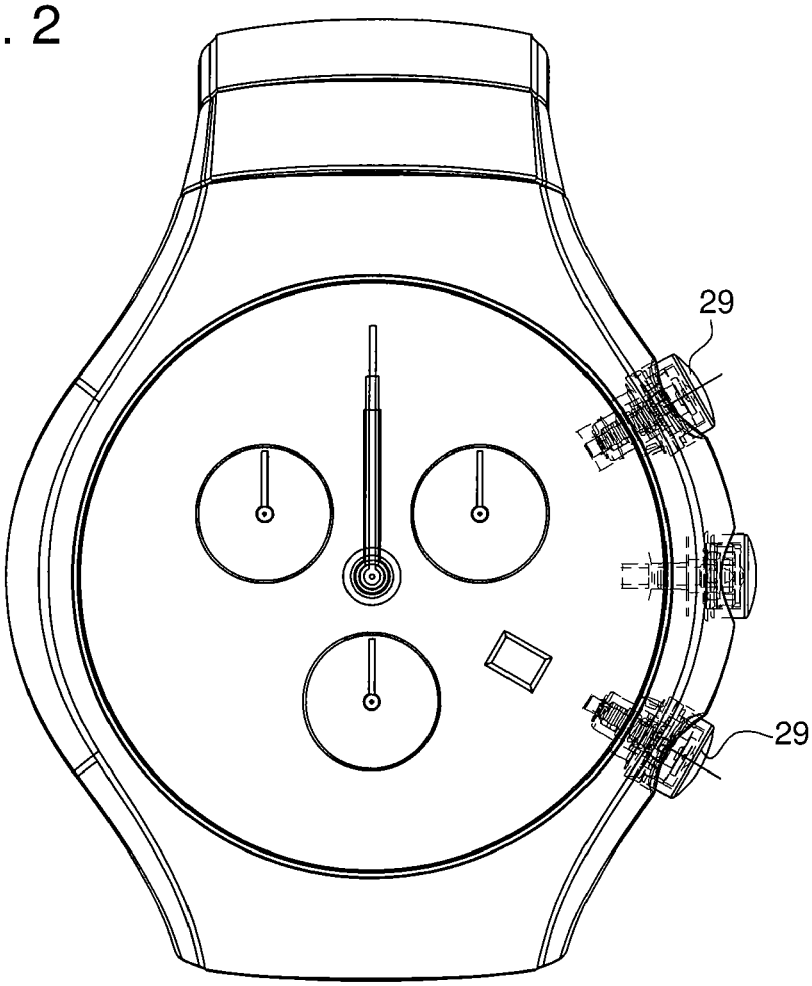
FIG. 2 is a top view of a chronograph watch whose case is formed by a steel centre covered with a ceramic cap, said chronograph watch including two push-button control devices according to the present invention.
Figure 3:
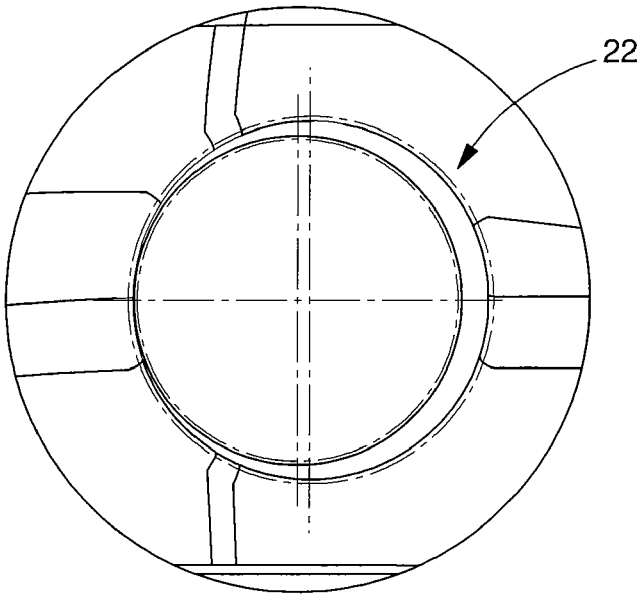
FIG. 3 is a partial enlarged view of the middle part of the chronograph watch of FIG. 2 in which one of the push-button control devices has been omitted to show, by way of example, possible poor alignment of the aperture made in the cap relative to the aperture made in the steel centre.
Figure 4:
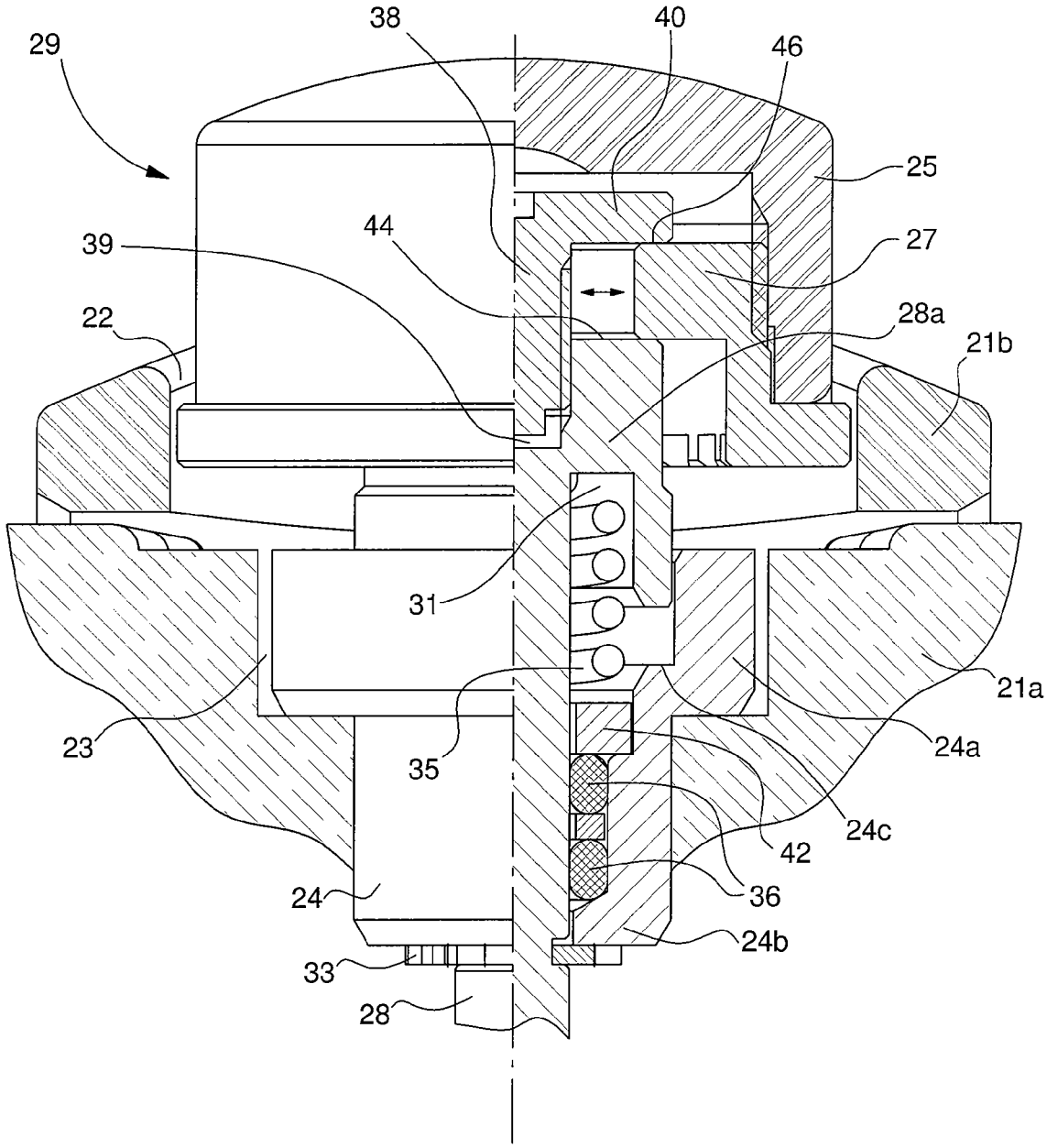
FIG. 4 is a mixed elevation view of a particular embodiment of the push-button control device according to the present invention, which also shows in partial cross-section the middle part of a watch in which the device is mounted, the device itself being half shown in cross-section.

FIG. 4 shows a partial cross-section of middle part 21*a*, 21*b* of a watch with a push-button control device in a particular embodiment of the present invention. This watch could be, for example the chronograph watch illustrated in FIG. 2. The middle part of the watch shown is double and includes an inner middle part made of steel (referenced 21*a*) and an outer middle part 21*b* forming part of a ceramic cap covering the steel watchcase. The middle part has a recess 22, which, in the present example, is circular and which is for receiving a button 29. The bottom of recess 22 has a bore 23 in which a push-button tube 24, fixed in inner middle part 21*a*, is engaged. It can be seen that, in this example, tube 24 is formed of two coaxial, cylindrical portions 24*a*, 24*b* of different diameters and joined to each other by a circular shoulder 24*c*. A push-button stem 28 is arranged inside tube 24 so as to slide axially between a top, rest position (shown in FIG. 4) and a bottom, active position (in the following pages, the terms "top", "bottom", "high" and "low", are used with reference to a push-button shown with its button oriented towards the top of the page as in FIG. 4).

It can be seen that, in the present embodiment, push-button stem 28 is capped by a top part or cylindrical head 28*a* of larger diameter. Head 28*a* includes, on its bottom face, an annular hollow 31 defining a skirt around the stem. The diameter of head 28*a* is such that it can slide inside the portion 24*a* of larger diameter of push-button tube 24, until it abuts in the active position against shoulder 24*c*. The travel of push-button stem 28 is limited in the other direction by a circlip 33 or retaining ring, which is secured to the stem and which abuts in the rest position against the bottom end of push-button tube 24. Two O-ring sealing gaskets 36, which seal tube 24 in a water-resistant manner, are arranged in the portion of tube 24*b* between stem 28 and the tube. A ring 42 that surrounds stem 28 and closes tube portion 24*b* at shoulder 24*c* holds the two sealing gaskets axially.

Push-button stem 28 is returned to the rest position by a helical spring 35 surrounding one portion of stem 28. Spring 35 abuts via one end thereof against the bottom of annular hollow 31, whereas the other end thereof is held by push-button tube 24 via ring 42.

According to the present invention, button 29 can shift sideways relative to the axis of stem 28. FIG. 4 shows that button 29 includes a hollow cap 25, which projects from recess 22 and which covers the top end of cylindrical head 28*a*. Cap 25 can advantageously be made from the same ceramic substrate as outer middle part 21*b*. Cap 25 is rigidly secured to an annular base element, or ring 27. As will now be explained, the annular base element 27 is mounted on cylindrical head 28*a* with some play. The tip of cylindrical head 28*a* is pierced with a threaded axial hole 39. A screw 40, whose threaded arbour 38 is capped by a disc-shaped head 40, is screwed into hole 39. The screw 40 passes through a central circular aperture of base element 27, such that this element is sandwiched between the tip of the push-button stem and the head of screw 40. As the diameter of the central aperture of base element 27 is less than both the diameter of cylindrical head 28*a* and the head of screw 40, button 29 cannot be detached from stem 28 without unscrewing screw 40. Moreover, the diameter of the central aperture of base element 27 is considerably greater that the diameter of threaded arbour 38, such that the base element can, within a certain limit, shift sideways relative to the axis of screw 40.

The top edge of head 28*a* of push-button stem 28 and the bottom edge of screw head 40 form two parallel shoulders which delimit an annular groove in which base element 27 is engaged. Moreover, in the present example, the presence of threaded arbour 38 allows the width of the annular groove to be adjusted by screwing or unscrewing screw 40. Advantageously, the width of the annular groove is determined such that base element 27 is held without any play in the axial direction. Thus, the pressure exerted by parallel shoulders 44, 46 on either side of base element 27 also has the effect of holding the latter with wet friction in the radial direction. Advantageously, the materials used for head 28*a* and screw 40 and base element 27 can be selected so as to encourage low-intensity wet friction. One could, for example, make head 28*a* and screw 40 of metal, stainless steel for example, and make base element 27 in a suitable plastic material, such as a polyamide for example.

In order to assemble the push-button control device of this example, one may proceed as follows: first of all the push-button is assembled without the button; then annular base element 27 is placed on head 28*a* of the push-button stem and these two elements are linked by screwing the threaded arbour 38 of screw 40 into threaded hole 39, after a drop of adhesive has been inserted therein. The tightening of screw 40 is then adjusted so as to obtain the desired intensity of wet friction between head 28*a*, screw 40 and base element 27. Finally, ceramic cap 25 is screwed or bonded to base element 27.

It will be clear that various alterations and/or improvements evident to those skilled in the art could be made to the embodiment that forms the subject of the present description, without departing from the scope of the invention defined by the annexed claims. In particular, neither button 29, nor recess 22 have to be circular. The button and recess can naturally have absolutely any shape. Moreover, the push-button control device may also be used with a watch whose middle part does not have a recess for the pushbutton, but only a bore provided for receiving the tube and push-button stem.

Moreover, in the case of the variant wherein the groove is formed via the coaxial assembly of two stem portions 28*a* and 40, the means for securing these two stem portions do not necessarily include a threaded arbour and a threaded hole. In fact, alternatively, it is possible to use, for example, a smooth arbour and a cylindrical hole: a drop of adhesive then being preferably used for holding the two parts in place.

What is claimed is:

1. A push-button control device for a watch, including a push-button stem inserted by a bottom end into an orifice in a watchcase and a button mounted on a top part of the stem outside the watchcase, said button including a cap that covers the top end of the stem, said stem being able to slide axially between at least a rest position and an active position against a return member to control at least one function of said watch, wherein said top part of the stem includes an annular groove delimited by two parallel shoulders perpendicular to the axis of the stem, and wherein the button includes an annular base engaged in said groove so as to be held in the axial direction between the two shoulders and centred with some play by the bottom of the groove such that the button is free to move off-centre relative to the axis of the stem, while remaining secured thereto.

2. The push-button control device according to claim 1, wherein said groove is formed by assembling, in a coaxial position, two stem portions, respective opposite surfaces of said two stem portions forming said two parallel shoulders, and wherein said two stem portions include complementary securing means that allow said assembly while maintaining some space between the two parallel shoulders.

3. The push-button control device according to claim 2, wherein said complementary securing means include a threaded axial hole formed in a first of said two stem portions and a threaded arbour forming part of the second of said two stem portions.

4. The push-button control device according to claim 2, wherein said assembly of the two stem portions is achieved by bonding.

5. The push-button control device according to claim 3, wherein said assembly of the two stem portions is achieved by bonding.

6. The push-button control device according to claim 1, wherein said two stem portions are made of metal, and wherein the annular base is made of plastic material.

7. The push-button control device according to claim 6, wherein said plastic material is polyamide.

* * * * *